United States Patent [19]

Molins et al.

[11] 4,042,112

[45] Aug. 16, 1977

[54] CONVEYING CIGARETTES AND OTHER ROD-LIKE ARTICLES

[75] Inventors: Desmond Walter Molins; Dennis Hinchcliffe; Peter Alec Clarke; Frank Heybourn, all of London, England

[73] Assignee: Molins Limited, England

[21] Appl. No.: 614,899

[22] Filed: Sept. 19, 1975

[30] Foreign Application Priority Data

Oct. 3, 1974 United Kingdom ..... 42872/74

[51] Int. Cl.[2] ..... B26D 7/06

[52] U.S. Cl. ..... 209/73; 198/417; 198/448; 198/601; 83/79; 83/102

[58] Field of Search ..... 209/73; 198/278–280, 198/32, 198/20 C, 37, 448, 601; 83/79, 102; 131/25

[56] References Cited

U.S. PATENT DOCUMENTS

| | | | |
|---|---|---|---|
| 3,262,243 | 7/1966 | Molins | 198/370 X |
| 3,620,349 | 11/1971 | McCombie | 198/78 |
| 3,633,735 | 1/1972 | Molins | 198/37 |
| 3,870,143 | 3/1975 | Heybourn | 198/280 |

FOREIGN PATENT DOCUMENTS

| | | | |
|---|---|---|---|
| 576,022 | 4/1958 | Italy | 198/20 C |

*Primary Examiner*—Allen N. Knowles
*Attorney, Agent, or Firm*—Craig & Antonelli

[57] ABSTRACT

Apparatus for conveying filter-tipped cigarettes, comprises means for receiving two streams of such cigarettes with the filters of the two streams facing in opposite directions, means for conveying the two streams side by side while twisting the streams in opposite directions about longitudinal axes of the streams so that the cigarettes of the two respective streams are then parallel, with the filters all facing in the same direction, and means for merging the two streams.

22 Claims, 6 Drawing Figures

CONVEYING CIGARETTES AND OTHER ROD-LIKE ARTICLES

One aspect of this invention is concerned with the tip-turning of filter-tipped cigarettes. Such cigarettes are commonly made by joining double-length filter portions between pairs of tobacco-filled rods, the assemblies thus formed being then cut through the middle to form two rows of filter-tipped cigarettes with the filters facing one another. It is then desirable to merge the two rows or streams to form a single row or stream with the filters of the cigarettes all facing in the same direction; this invention is mainly concerned with an improved way of doing that.

According to one aspect of the present invention, apparatus for conveying filter-tipped cigarettes comprises means for receiving two streams of such cigarettes (which may be single-row streams or stack-like streams) with the filters of the two streams facing in opposite directions, means for conveying the two streams side-by-side while twisting the streams in opposite directions (e.g., both through substantially 90°) about longitudinal axes of the streams so that the cigarettes of the two respective streams are then parallel with the filters all facing in the same direction, and means for merging the two streams.

This invention obviates the need for a rotating disc or equivalent tip-turning device and can result in an economy.

The apparatus preferably includes means for forming the two streams of cigarettes into stacks before twisting, the stacks being preferably twisted as a result of passing downwards through twisted chutes. The two stacks, after passage through the chutes, may be carried by conveyors which merge the stacks in accordance with the third aspect of this invention described below. Alternatively the two stacks, after twisting, may pass into a junction zone above a further chute which conveys the combined stack downwards and may twist the stack through 90° so as to return the cigarette axes to their original orientation.

According to a second aspect of this invention, apparatus for conveying filter-tipped cigarettes comprises means for receiving two streams of filter-tipped cigarettes with the filters of the two streams facing in opposite directions, means for forming each of the streams into a continuous stack, means for conveying at least one stack while twisting it about a longitudinal axis of the stack so that the filters in the two stacks then face in the same direction, and means for combining the two stacks.

A third aspect of this invention is concerned generally with the merging of two streams of cigarettes or similar rod-like articles conveyed in stack formation. In this context the articles will be referred to as "cigarettes", but it should be understood that this aspect of the invention is also applicable to other rod-like articles, for example cigarette filter rods.

According to this third aspect of the invention, apparatus for merging two stack-like streams of cigarettes or similar rod-like articles comprises a first conveyor for carrying one of the streams substantially horizontally into a junction zone, a second conveyor for conveying the second stream obliquely upwards into the junction zone, and a third conveyor for carrying the combined stream away from the junction zone.

This stack merging apparatus can be useful in circumstances in which one or other conveyor carrying a stack towards the junction zone stops from time to time. While one conveyor is stationary, the third conveyor carries from the junction zone a stack of cigarettes received entirely from the conveyor which is still carrying cigarettes into the junction zone. While such operation is taking place, the cigarettes on the stationary conveyor are not, to any significant extent, dragged into the junction by the action of the moving conveyor as could happen with some prior proposals. In order to ensure that cigarettes are not dragged from the substantially horizontal conveyor while it is stationary, that conveyor may also be arranged to move along a slightly upwardly inclined path.

Examples of apparatus according to this invention are shown in the accompanying drawings. In these drawings.

Figure 1:
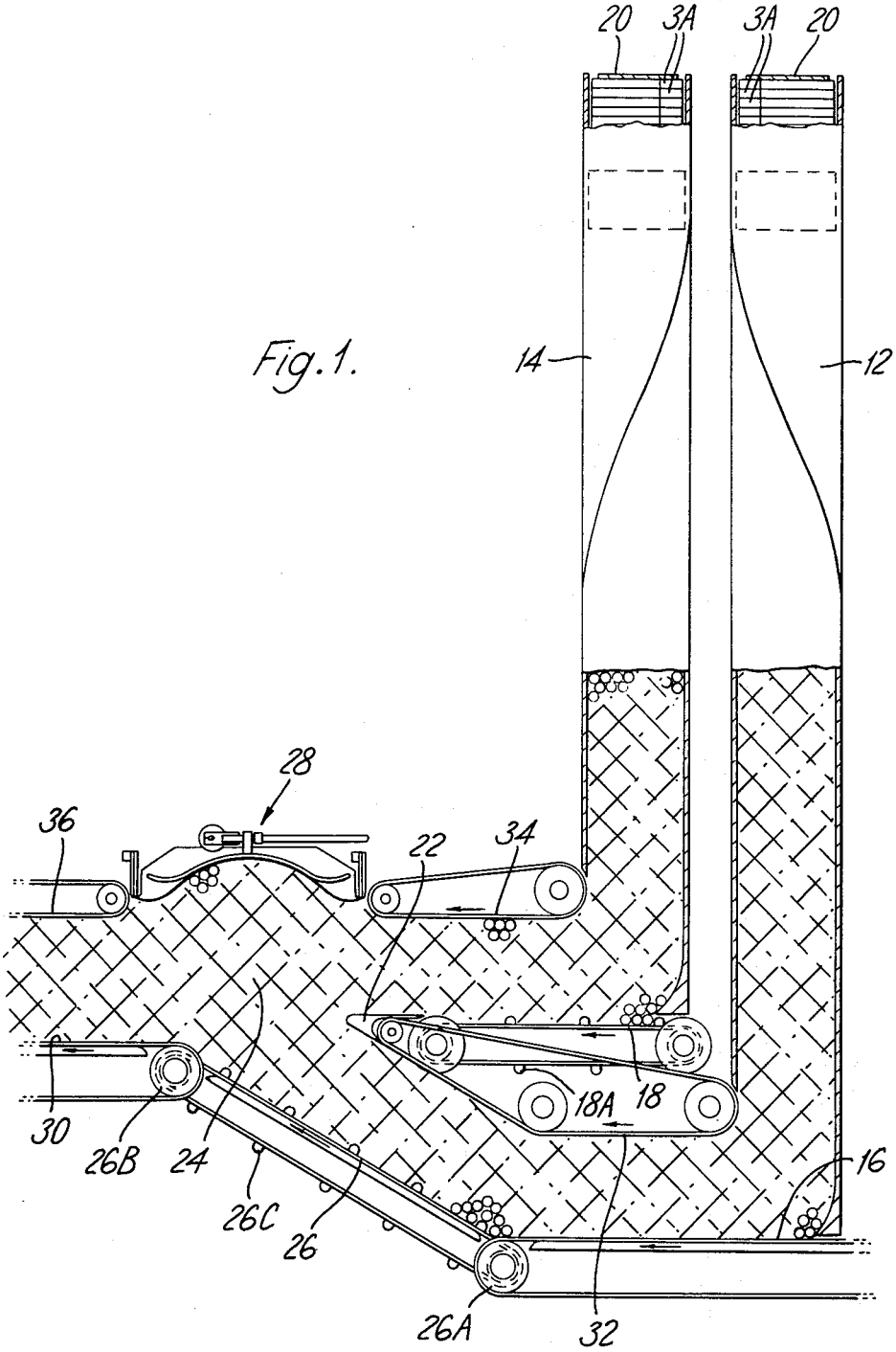
FIG. 1 is a partly sectioned side elevation of one apparatus which tip-turns and then merges two stacks.
Figure 2:
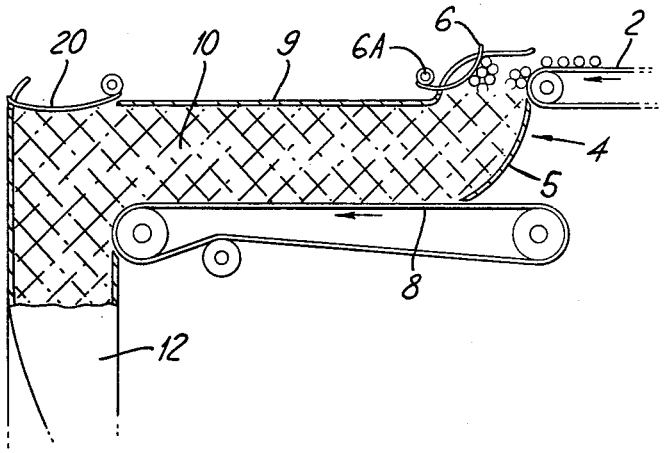
FIG. 2 is a partly sectioned elevation, taken from the right, of part of the apparatus shown in FIG. 1.

The apparatus shown in FIGS. 1 and 2 has two conveyors 2 (of which only one can be seen in FIG. 2) arranged to receive two single-row streams of filter-tipped cigarettes 3. Each conveyor 2 carries one stream to a stack-forming device 4 which includes a fixed wall 5, a pivoted sensor plate 6 which is pivoted at 6A, and a conveyor 8 which moves in response to the sensor 6, e.g., at a smoothly variable speed, so as to form a stack 10 of cigarettes of uniform height.

The stack 10 is bounded by a top wall 9. This wall, or part of it, may be omitted to allow hand sampling; i.e., to allow the machine operator to remove a handful of cigarettes from either stream from time to time to check the cigarettes. The stack 10 is delivered into a chute 12 which has a 90° twist about its vertical axis as shown particularly in FIG. 1. The second chute, referenced 14 in FIG. 1, twists through 90° in the opposite direction.

Thus the two streams of cigarettes, which initially have their filters 3A facing one another (as shown in FIG. 1) are re-orientated as they pass down the chutes 12 and 14 so that the cigarette axes become parallel with the filters facing in the same direction. It should be noted that the centers of the cigarettes now lie in a common plane transverse to the axes of the cigarettes, so that the two streams of cigarettes can be merged by movement purely in directions transverse to the axes of the cigarette.

The chute 12 delivers one stack of cigarettes onto a smooth horizontal conveyor 16, while the chute 14 delivers the other stack of cigarettes onto a horizontal conveyor 18 which has transverse rib-like projections 18A arranged at regular intervals on its outer surface. Sensors 20 above the chutes respond to the pressure of the cigarettes above the chutes and respectively control the speeds of the conveyors 16 and 18 so as to keep the level of cigarettes above the chutes (i.e., adjacent to the sensors 20) within desired limits.

The stack of cigarettes carried by the conveyor 18 passes over a fixed bridge 22 and into a junction zone 24. The other stack of cigarettes is carried obliquely upwards into the junction zone 24 by a further ribbed conveyor 26. Above the junction zone 24 there is a pivoted sensor 28 which controls the speed at which a conveyor 30 carries the combined stack of cigarettes from the junction zone 24.

The various stacks of cigarettes on the conveyors have their upper surfaces confined by upper bands 32, 34 and 36. These are driven respectively at the same speeds as the conveyors 16, 18 and 30.

The sensor 28 is described in more detail in U.S. Pat. application Ser. No. 562,396 (and corresponding German OS No. 2,513,245).

The ribbed conveyors 18 and 26 embody an invention which is further described in U.S. Pat. Appln. Ser. No. 408,256 (and corresponding German OS No. 2,353,806), to which reference is directed in its entirety. For example, the conveyor 26 passes around relatively small diameter middle portions of two pulleys 26A and 26B which have larger-diameter outer portions around which narrow parallel bands forming the conveyors 16 and 30 pass respectively; thus the rib-like protrusions 26C, while in the region of the pulleys, are confined between the larger-diameter outer parts of the pulleys.

The part of the apparatus shown in FIG. 2 may be modified as follows. The chute 12 (and similarly the chute 14) may be positioned adjacent to the end of the conveyor 2, so that the single-row stream of cigarettes is delivered into the zone above the chute. The conveyor 8 in this case is omitted, as so is the sensor 6 or the sensor 20. Hand sampling may then be provided for in connection with the merged streams on the conveyor 30; for that purpose the top band 36 would be shortened or omitted.

Figure 3:
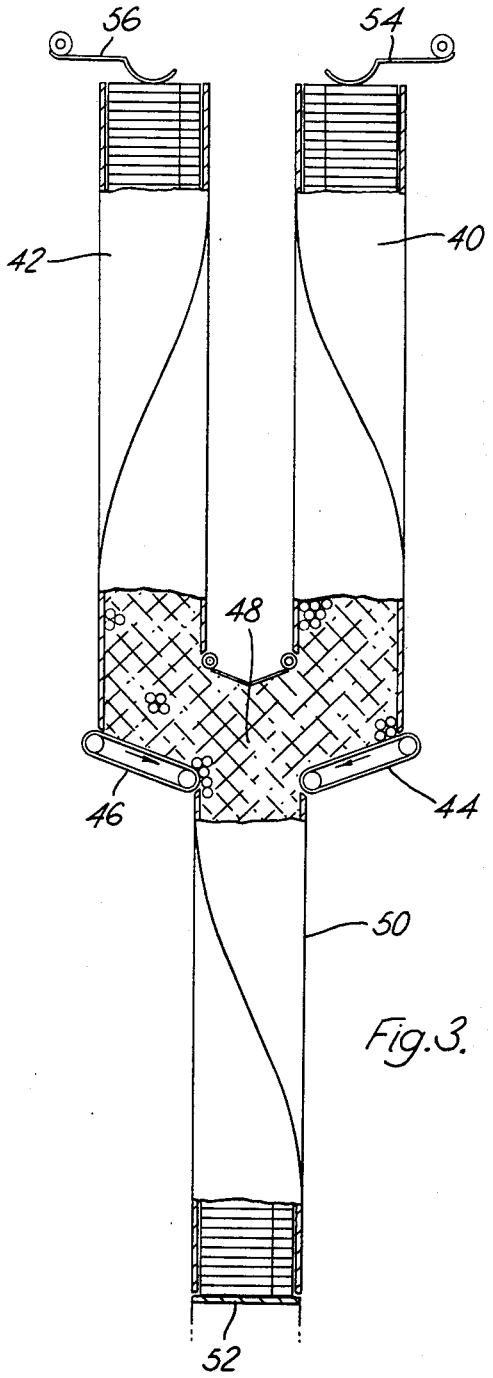
FIG. 3 shows a second apparatus for tip-turning and merging two stacks of cigarettes.

FIG. 3 shows a modification of the arrangement of FIG. 1. It includes two twisted chutes 40 and 42 which receive two streams of cigarettes in stack formation from the conveyors 8 in FIG. 2, and twist them both through 90° in opposite directions as in the apparatus shown in FIG. 1. At the lower end of the chutes 40 and 42 there are downwardly inclined conveyors 44 and 46 respectively which convey or assist movement of the stacks into a junction zone 48 above a chute 50. This chute 50 is also twisted through 90° about its vertical axis, so that the combined stack delivered from the lower end of the chute 50 has the cigarette axes again in the same orientation as at the start. The combined stack may then be carried further on a horizontal conveyor 52 which is parallel to the conveyors 8 shown in FIG. 2.

The speeds of the conveyors 44 and 46 may be controlled respectively by sensors 54 and 56 which are shown diagrammatically in FIG. 3 and may in fact be similar to the sensor 20 shown in FIG. 2

Instead of the conveyor 52 being parallel to the conveyors 8, it could be at right angles to the conveyors 8, in which case it could receive the merged streams directly from the junction zone 48, possibly via a short non-twisted chute. This would enable the conveyor 52 to be at a higher level. Hand sampling in either case is preferably allowed for on the conveyor 52.

Figure 4:
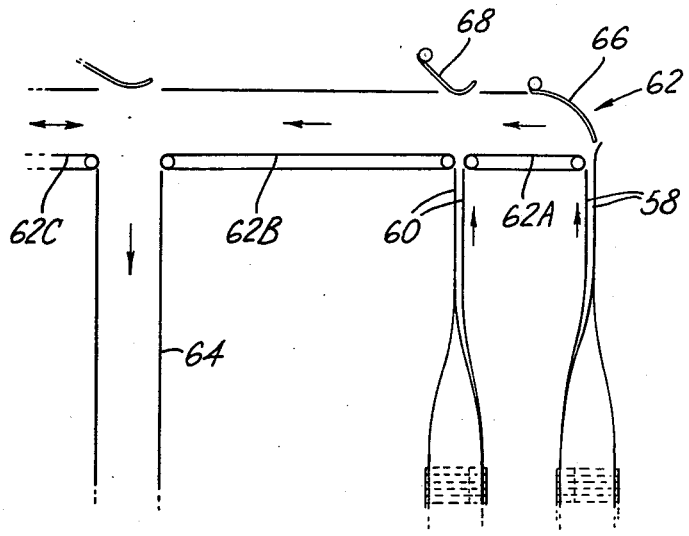
FIG. 4 is a diagrammatic side elevation of an apparatus for tip turning single-row streams of cigarettes and then merging them.

FIG. 4 shows a different apparatus for tip-turning and merging two streams of cigarettes. Each stream, while in single-row formation, is gripped between two parallel moving bands 58 or 60 which are constrained to twist through 90° about a vertical axis as they move upwards. Thus the cigarettes arrive at an overhead conveyor system 62 with their filters all facing the same direction. The overhead conveyor system carries a stack of cigarettes into which the two single-row streams are injected in the manner described basically in British Pat. specification No. 1,309,741. The overhead conveyor system comprises conveyors 62A, 62B and 62C, conveyor 62C being part of a reversible reservoir. Any cigarettes which do not pass into the reservoir are delivered into a chute 64 which carries the cigarettes to a cigarette packing machine. When demand for cigarettes exceeds the supply from the cigarette making machine, cigarettes are delivered from the reservoir and into the chute 64.

Conveyors 62A and 62B are controlled as to their speed respectively by pivoted sensors 66 and 68.

As an alternative the system shown in FIG. 4 could be modified in the following way. Each single-row stream is formed into a stack, e.g., in the manner shown in FIG. 2, and the two stacks are then elevated and twisted, for example by ribbed conveyors as described in our abovementioned patent application, and are fed into a horizontal overhead stack.

Figure 5:
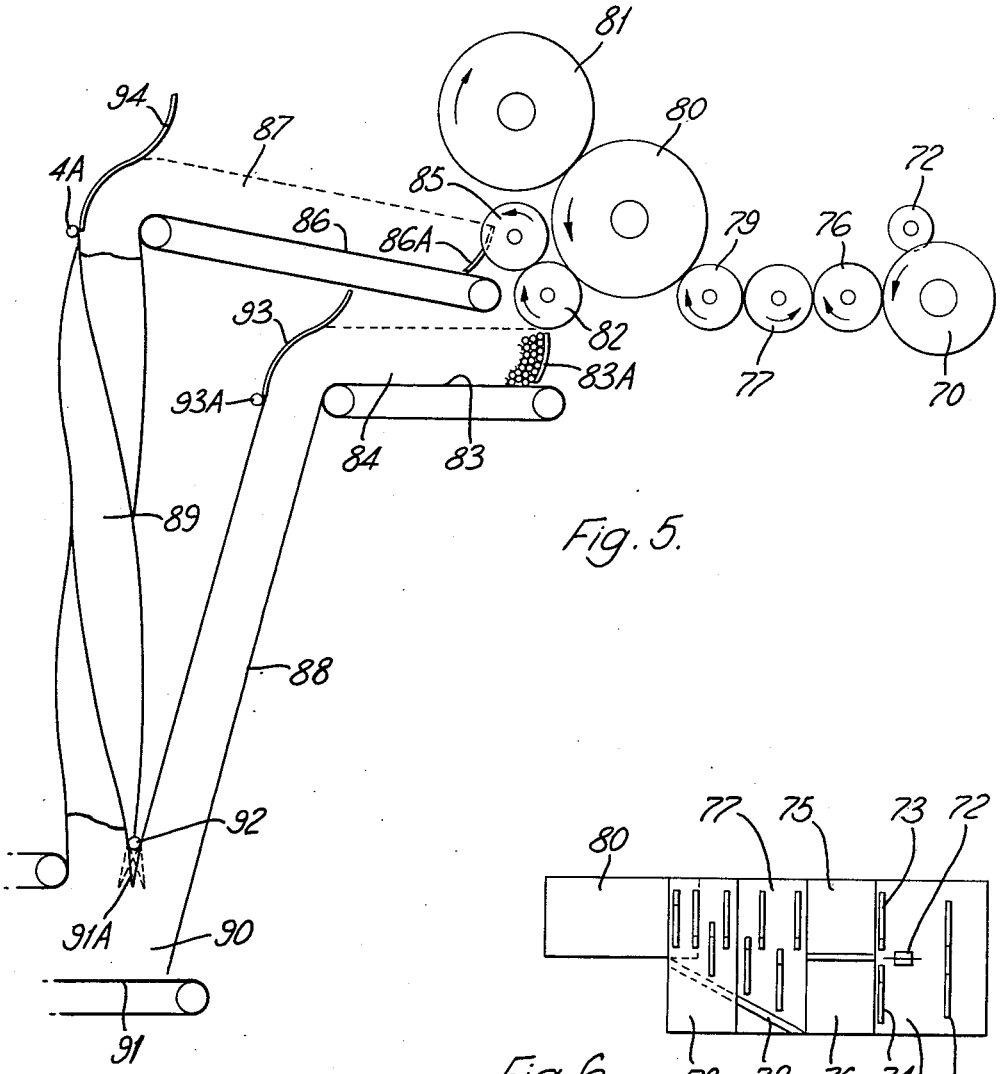
FIG. 5 is a diagrammatic side elevation of another different apparatus.
Figure 6:
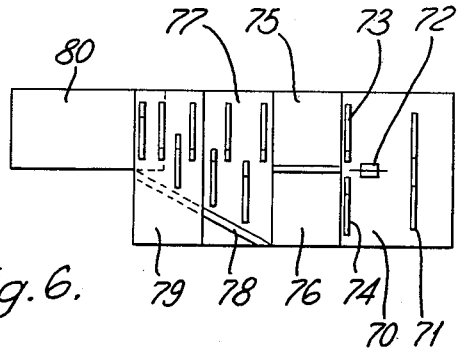
FIG. 6 is a diagrammatic plan view of part of the apparatus shown in FIG. 5.

FIG. 5 is a side view of another different apparatus and; FIG. 6 is a diagrammatic plan view of part of the apparatus.

The apparatus shown in FIGS. 5 and 6 includes a final-cut drum 70 which forms part of a filter-attachment machine. This drum receives a stream of assemblies 71 each comprising axially spaced tobacco filled portions joined to opposite ends of a double-length filter portion. A disc knife 72 cuts the assemblies 71 through the middle to form two rows of filter-tipped cigarettes 73 and 74 respectively. A plough (not shown) may be included to move the two rows of cigarettes apart slightly before they are transferred from the drum 70.

The two rows of cigarettes 73 and 74 are received respectively by two coaxial fluted suction drums 75 and 76. These drums rotate at slightly different speeds (and have slightly different flute pitches) so that the cigarettes 73 and 74 are received by a further fluted suction drum 77 in staggered formation, alternate flutes of the drum 77 receiving cigarettes 73 and 74. While being carried by the drum 77, the cigarettes 74 are moved axially by a ramp 78, as shown in FIG. 6. This movement is continued by an extension of the ramp which passes around a further fluted suction drum 79, so that the cigarettes 73 and 74 are finally aligned to form a single row. This single row is then transferred to a drum 80 forming part of a cigarette testing device which includes a cooperating drum 81 as described in our British Pat. specification No. 1,217,203.

A further drum 82 receives the cigarettes from the testing drum 80, and any faulty cigarettes may be ejected from the drum 82 in any known manner. At a position near the bottom of the drum 82, suction is released from alternate flutes so as to deliver alternate cigarettes (e.g., cigarettes 74) on to a conveyor band 83 on which the cigarettes form a stack 84 in front of a fixed wall 83A. The remaining cigarettes (e.g., cigarettes 73) are received by a suction drum 85 which delivers them on to a second band conveyor 86 on which the cigarettes form a stack 87 in front of a fixed wall 86A.

At the downstream ends of the conveyors 83 and 86 there are chutes 88 and 89 respectively, the chute 89 being twisted through 180° about its longitudinal center line. Thus the stacks 84 and 87 are fed downwards through the chutes towards a junction zone 90 above a conveyor 91 which carries away the combined stack. As a result of the 180° twist of the chute 89, the cigarettes all arrive in the junction 90 with their filters facing in the same direction.

Parts of the lower end portions of adjacent walls of the chutes are formed by a pivoted flap member 91A which is pivoted about a horizontal axis at 92. The flap normally takes up the position shown in solid outline allowing free passage of cigarettes through both chutes into the junction zone 90. However, when the flow rate through one chute is reduced, for example as a result of a handful of cigarettes being taken from one of the stacks in the exposed area above the conveyors 83 and 86 for individual inspection, a sensor 93 or 94 above the corresponding chute detects the fall in the level of cigarettes arriving at the sensor and causes an operating device to move the flap 91 about its axis 92 to the appropriate broken-outline position so as to reduce or stop the flow of cigarettes through that chute until the level of cigarettes above the chute (i.e., below the corresponding sensor 93 or 94) has been restored; this prevents the formation of voids in the chute such as could result in cigarettes falling in an uncontrolled manner and becoming skew.

The sensors 93 and 94 are pivoted at 93A and 94A respectively.

The following additions and modifications are possible.

Sensors may be provided above the bands 83 and 86, near the fixed walls 83A and 86A respectively, to monitor the height of the stack formed on the bands and to control the movement of the bands (either by varying the speeds of the bands or by stopping and starting either band when necessary) to maintain the heights of the stacks 84 and 87.

The sensors 93 and 94 may be replaced by simple micro-switches serving as limit switches.

A logic circuit may be used to control the speed of the band 91 in accordance, for example, with whether one or both chutes are delivering cigarettes.

The flap 91 may be replaced by a fixed wall, in which case the sensors 93 and 94 may respectively control the speeds of the conveyors 84 and 86.

Another possible modification is that there may be ramps such as the ramp 78 at both ends of the drum 77 so as to move both rows of cigarettes 73 and 74 towards the center of the drum 77. In that case the two rows may become completely aligned while on the drum 77, and the drum 79 may be of a reduced width sufficient to receive a single row; it will be understood that the testing drum 80 and the cooperating drums downstream of it (and also the drum 79) would then be moved axially so as to be aligned with the center of the drum 77.

We claim:

1. Apparatus for conveying filter-tipped cigarettes, comprising means for receiving two streams of such cigarettes with the filters of the two streams facing in opposite directions, means for conveying the two streams side by side while twisting the streams in opposite directionsabout longitudinal axes of the streams so that the cigarettes of the two respective streams are then parallel, with their centers all lying substantially in a common plane transverse to the axes of the cigarettes and with the filters all facing in the same direction, and means for merging the two streams by movement of the streams substantially in directions transverse to the axes of the cigarettes.

2. Apparatus according to claim 1 in which the two streams are in stack formation and in which the means for twisting the two streams comprise twisted chutes through which the streams pass under gravity in a downward direction.

3. Apparatus according to claim 2 in which the means for merging the two streams comprise a first conveyor for carrying one of the streams substantially horizontally into a junction zone, a second conveyor for conveying the second stream obliquely upwards into the junction zone, and a third conveyor for carrying the combined stream away from the junction zone.

4. Apparatus according to claim 3 in which at least the second conveyor is formed with transverse rib-like protrusions for engaging the cigarettes.

5. Apparatus according to claim 2 in which the means for merging the two streams comprise two conveyors which converge and carry the streams into a junction zone lying between the two conveyors.

6. Apparatus according to claim 2 in which each stack of cigarettes is delivered into the upper end of the corresponding chute by a horizontal conveyor which carries the cigarettes in stack formation, allowing a machine operator to remove a handful of cigarettes when required to examine the cigarettes.

7. Apparatus according to claim 1 in which the two streams comprise single rows each of which is fed upwards between two twisted bands toward an overhead conveyor carrying a stack of cigarettes into which the two rows are injected by the bands.

8. Apparatus according to claim 1 in which each of the streams is twisted through 90°.

9. Apparatus for conveying filter-tipped cigarettes, comprising means for receiving two streams of filter-tipped cigarettes with the filters of the two streams facing in opposite directions, means for forming each of the streams into a continuous stack, means for conveying at least one stack while twisting it about a longitudinal axis of the stack so that the filters in the two stacks then face in the same direction and the centers of all of the cigarettes lie substantially in a common plane transverse to the axes of the cigarettes, and means for combining the two stacks by movement of the stacks substantially in directions transverse to the axes of the cigarettes.

10. Apparatus according to claim 9 in which each of the stacks is twisted through approximately 90°, the two stacks being twisted in opposite directions.

11. Apparatus according to claim 9 in which only one stack is twisted, the angle of twist being 180°.

12. Apparatus according to 9 in which both stacks are fed downwards towards a junction zone through a respective chute, the twisting of at least one of the stacks being produced as a result of the corresponding chute being twisted about a longitudinal axis.

13. Apparatus according to claim 12 in which the two stacks are delivered into respective chutes by two conveyors lying one above the other.

14. Apparatus for use in the manufacture of filter-tipped cigarettes comprising a conveyor for feeding rod assemblies, each comprising two tobacco portions jointed to opposite ends of a double-length filter portion; means for cutting the assemblies through the middle to form two rows of filter-tipped cigarettes; means for staggering the rows; means for merging the two rows into one combined stream; a cigarette testing device for testing successive cigarettes in the combined stream and for ejecting faulty cigarettes; means for separating the alternate cigarettes back into two separate rows, one above the other; and means for twisting the cigarettes of one of the rows through 180° and for then combining all the cigarettes into one stream.

15. Apparatus for merging two stack-like streams of cigarettes or similar rod-like articles into a single combined stack-like stream, comprising first conveyor means for carrying one of the streams substantially horizontally into a junction zone, second conveyor means for conveying the second stream obliquely upwards into the junction zone, third conveyor means mounted at substantially the same level as the firt conveyor means for carrying the combined stream formed by said first and second streams away from the junction zone and sensor means responsive to the quantity of cigarettes in the junction zone for controlling the speed of said third conveyor means.

16. Apparatus according to claim 15 in which at least the second conveyor means includes a conveyor formed with transverse rib-like protrusions for engaging the cigarettes.

17. Apparatus for conveying filter-tipped cigarettes, comprising means for receiving two streams of such cigarettes with the filters of the two streams facing in opposite directions, means for conveying the two streams side by side while twisting the streams in opposite directions about longitudinal axes of the streams so that the cigarettes of the two respective streams are then parallel, with the filters all facing in the same direction, and means for merging the two streams comprising a first conveyor for carrying one of the streams substantially horizontally into a junction zone, a second conveyor for conveying the second stream obliquely upwards into the junction zone, and a third conveyor for carrying the combined stream away from the junction zone.

18. Apparatus according to claim 17 in which the speed of the third conveyor is controlled by a sensor responsive to the quantity of cigarettes in the junction zone.

19. Apparatus for conveying filter-tipped cigarettes, comprising means for receiving two streams of such cigarettes with the filters of the two streams facing in opposite directions, means for conveying the two streams side by side while twisting the streams in opposite directions about longitudinal axes of the streams so that the cigarettes of the two respective streams are then parallel, with the filters all facing in the same direction, and means for merging the two streams comprising two conveyors which converge and carry the stream into a junction zone lying between the two conveyors.

20. Apparatus according to claim 19 including a chute extending downwards from the junction zone and arranged to deliver the combined streams onto a further conveyor.

21. Apparatus according to claim 20 in which the chute for the combined streams is twisted through approximately 90° about a vertical axis.

22. Apparatus for conveying filter-tipped cigarettes, comprising means for receiving two streams of such cigarettes with the filters of the two streams facing in opposite directions, means for twisting at least one of the streams about a central axis extending in the direction of movement of the stream, thereby causing the cigarettes of both streams to be similarly oriented and to lie with all their centers substantially in a common plane, and means for merging the two streams by movement of the streams substantially in directions transverse to the axes of the cigarettes.

* * * * *